US009333763B2

(12) United States Patent
Horade

(10) Patent No.: US 9,333,763 B2
(45) Date of Patent: May 10, 2016

(54) INKJET PRINTER AND COMPUTER-READABLE RECORDING MEDIUM CONTAINING PROGRAM THEREFOR

(71) Applicant: BROTHER KOGYO KABUSHIKI KAISHA, Nagoya, Aichi (JP)

(72) Inventor: Kenta Horade, Tokai (JP)

(73) Assignee: Brother Kogyo Kabushiki Kaisha, Nagoya, Aichi (JP)

( * ) Notice: Subject to any disclaimer, the term of this patent is extended or adjusted under 35 U.S.C. 154(b) by 0 days.

(21) Appl. No.: 14/561,294

(22) Filed: Dec. 5, 2014

(65) Prior Publication Data

US 2015/0158292 A1 Jun. 11, 2015

(30) Foreign Application Priority Data

Dec. 6, 2013 (JP) ..... 2013-252787

(51) Int. Cl.
*B41J 2/21* (2006.01)
*B41J 11/00* (2006.01)

(52) U.S. Cl.
CPC ..... *B41J 2/2135* (2013.01); *B41J 11/003* (2013.01); *B41J 11/008* (2013.01)

(58) Field of Classification Search
CPC ..... B41J 11/008
See application file for complete search history.

(56) References Cited

U.S. PATENT DOCUMENTS 6,438,509 B1 * 8/2002 Hayama et al. ..... 702/155
8,235,492 B2 8/2012 Saito et al.
8,657,436 B2 2/2014 Noguchi et al.
8,820,876 B2 9/2014 Hoshi et al.

FOREIGN PATENT DOCUMENTS

JP 2004-090316 A 3/2004

OTHER PUBLICATIONS

U.S. Appl. No. 14/674,030, filed Mar. 31, 2015.
Notice of Allowance dated Jul. 2, 2015 from related U.S. Appl. No. 14/674,030.

* cited by examiner

*Primary Examiner* — Justin Seo
(74) *Attorney, Agent, or Firm* — Scully, Scott, Murphy & Presser, PC

(57) ABSTRACT

An inkjet printer is provided with a conveyor, a carriage movable in a scanning direction, and mounting a printing head and a sensor configured to output a detection signal based on absence/presence of the sheet, and a controller. The controller is configured to obtain image data representing an image to be printed on the sheet, calculate, based on the image data, an estimate margin value which is used to determine a margin width at an end, in a scanning direction, of the sheet, and detect end positions, in the scanning direction, of the sheet based on the detection signal during movement of the carriage in the scanning direction when the margin width estimated based on the estimate margin value is less than a threshold width, while the detection process is not executed when the margin width is not less than a threshold width.

11 Claims, 9 Drawing Sheets

INKJET PRINTER AND COMPUTER-READABLE RECORDING MEDIUM CONTAINING PROGRAM THEREFOR

CROSS-REFERENCE TO RELATED APPLICATION

This application claims priority under 35 U.S.C. §119 from Japanese Patent Application No. 2013-252787 filed on Dec. 6, 2013. The entire subject matter of the application is incorporated herein by reference.

BACKGROUND

1. Technical Field

The present disclosures relate to an inkjet printer and a computer-readable recording medium storing a program for such an inkjet printer.

2. Related Art

Conventionally, there has been known an inkjet printer configured to eject ink drops onto a recording medium (e.g., a printing sheet), which is being conveyed, to form an image thereon. Such an inkjet printer is generally provided with a printing head configured to eject ink drops, a sensor configured to output a detection signal representing presence/absence of the recording medium, and a carriage mounting the printing head and the sensor thereon and configured to be movable in a scanning direction which is orthogonal to a conveying direction of the recording medium.

SUMMARY

Among inkjet printers configured as above, there has been known one which is configured to detect an end position of a printing sheet in the scanning direction, and compensate for ejection timings of the ink drops based on the end position detected by the sensor so that the image is printed at an appropriate position on the printing sheet.

However, a process of detecting the end position of the printing sheet may be a cause for lowering a throughput in printing operation. Further, depending on the size of the image, a user may not have uncomfortable feeling even though the image is formed at a position deviated in a scanning direction. In such a case, the deviation of the image on the printing sheet does not affect a user's subjective image quality so much.

In consideration of the above-described circumstances, aspects of the present disclosures provide an improved inkjet printer of which lowering of throughput in an image printing process can be suppressed.

According to aspects of the disclosures, there is provided an inkjet printer, which is provided with a conveyor configured to convey a sheet in a conveying direction, a carriage configured to be movable in a scanning direction which intersects with the conveying direction, the carriage mounting a printing head configured to eject ink drops on the sheet conveyed by the conveyor and a sensor configured to output a detection signal based on absence/presence of the sheet at a position facing the sensor, and a controller. The controller is configured to execute an obtaining process in which the controller obtains image data representing an image to be printed on the sheet, an ejection timing calculation process in which the controller calculates ejection timings to cause the printing head to eject the ink drops to print the image represented by the image data on the sheet located at a reference position which is a predetermined position in the scanning direction, a margin calculation process in which the controller calculates, based on the image data, an estimate margin value which is used to determine a margin width at an end, in the scanning direction, of the sheet, a detection process in which the controller detects end positions, in the scanning direction, of the sheet based on the detection signal during movement of the carriage in the scanning direction in response to the margin width estimated based on the estimate margin value being less than a threshold width, and a printing process in which the controller causes the printing head to ejects the ink drops with moving the carriage in the scanning direction. In the printing process, the controller causes the printing head to eject the ink drops in accordance with the ejection timings, which the controller calculates in the ejection timing calculation process, in response to the margin width being equal to or greater than the threshold width, and the controller causes the printing head to eject the ink drops in accordance with compensated ejection timings, which are compensated by the controller based on the end positions detected by the controller in the detection process, in response to the margin width being less than the threshold width.

According to other aspects of the disclosures, there is provided an inkjet printer which is provided with a conveyor configured to convey a sheet in a conveying direction, a carriage configured to be movable in a scanning direction which intersects with the conveying direction, the carriage mounting a printing head configured to eject ink drops on the sheet conveyed by the conveyor and a sensor configured to output a detection signal based on absence/presence of the sheet at a position facing the sensor, and a controller. The controller is configured to execute an obtaining process in which the controller obtains image data representing an image to be printed on the sheet, a margin calculation process in which the controller calculates, based on the image data, an estimate margin value which is used to determine a margin width at an end, in the scanning direction, of the sheet, and a detection process in which the controller detects end positions, in the scanning direction, of the sheet based on the detection signal during movement of the carriage in the scanning direction in response to the margin width estimated based on the estimate margin value being less than a threshold width. The detection process is not executed in response to the margin width estimated based on the estimate margin value being equal to or greater than a threshold width.

According to further aspects of the disclosures, there is provided a non-transitory computer readable recording medium storing instructions to be executed by a computer communicatably connected to an inkjet printer which is provided with a conveying device configured to convey a sheet in a conveying direction, and a carriage configured to be movable in a scanning direction which intersects with the conveying direction, the carriage mounting a printing head configured to eject ink drops on the sheet conveyed by the conveying device and a sensor configured to output a detection signal based on absence/presence of the sheet at a position facing the sensor. The instructions cause the computer to execute an obtaining process in which the computer obtains image data representing an image to be printed on the sheet, an ejection timing calculation process in which the computer calculates ejection timings to cause the printing head to eject the ink drops to print the image represented by the image data on the sheet located at a reference position which is a predetermined position in the scanning direction, a margin calculation process in which the computer calculates, based on the image data, an estimate margin value which is used to determine a margin width at an end, in the scanning direction, of the sheet, a detection process in which the computer detects end positions, in the scanning direction, of the sheet based on the detection signal during movement of the carriage in the scanning direction in response to the margin width estimated based on the estimate margin value being less than a threshold width, and a printing process in which the computer causes the printing head to ejects the ink drops with moving the carriage in the scanning direction. In the printing process, the computer causes the printing head to eject the ink drops in accordance with the ejection timings, which the computer calculates in the ejection timing calculation process, in response to the margin width being equal to or greater than the threshold width, and the computer causes the printing head to eject the ink drops in accordance with compensated ejection timings, which are compensated by the computer based on the end positions detected by the computer in the detection process, in response to the margin width being less than the threshold width.

It is noted that the computer communicatably connected to the conveying device and the printing device may be a computer connected, through a communication line, to an inkjet printer having a conveyor and a printing unit. Alternatively, the computer may be a CPU or the like connected to a conveying device and the printing device, which are components of the inkjet printer, through inner bus.

According to the aspects of the disclosures, lowering of the throughput in printing process can be suppressed.

BRIEF DESCRIPTION OF THE ACCOMPANYING DRAWINGS

Figure 3:
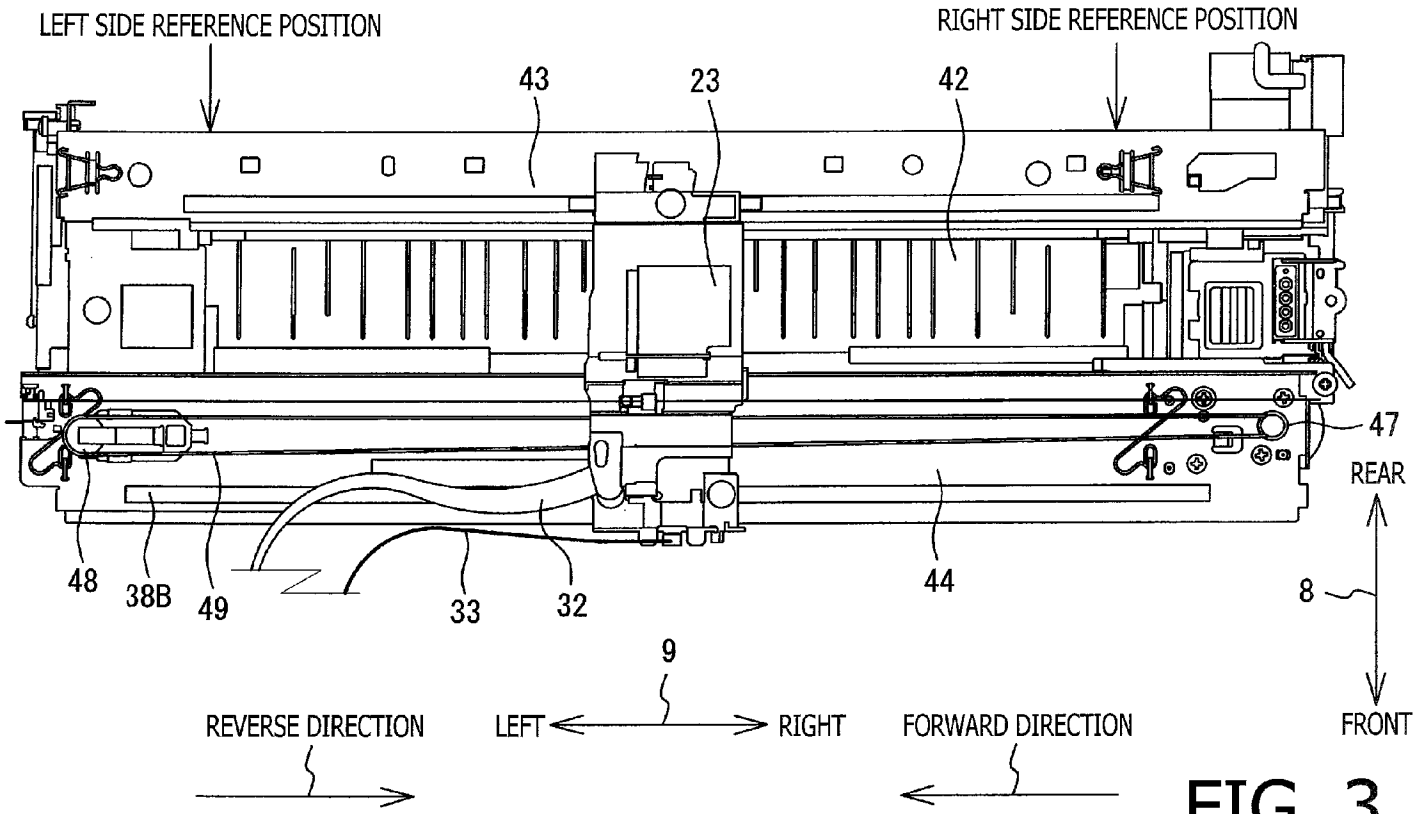

FIG. 3 a plan view of a carriage and guide rails 43 and 44 according to aspects of the disclosures.

Figure 4:
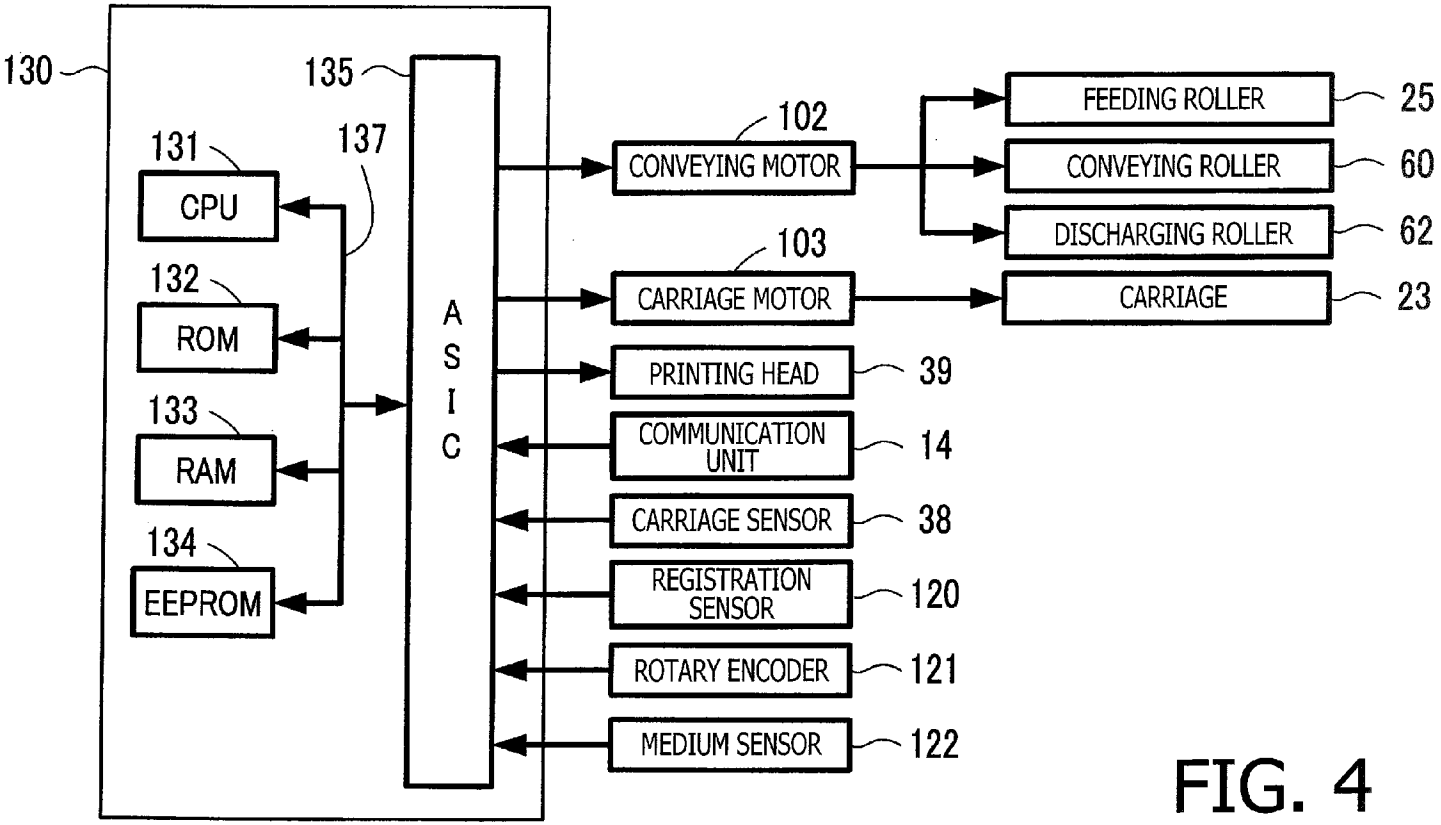

FIG. 4 is a block diagram of the printer unit according to aspects of the disclosures.

Figure 5:
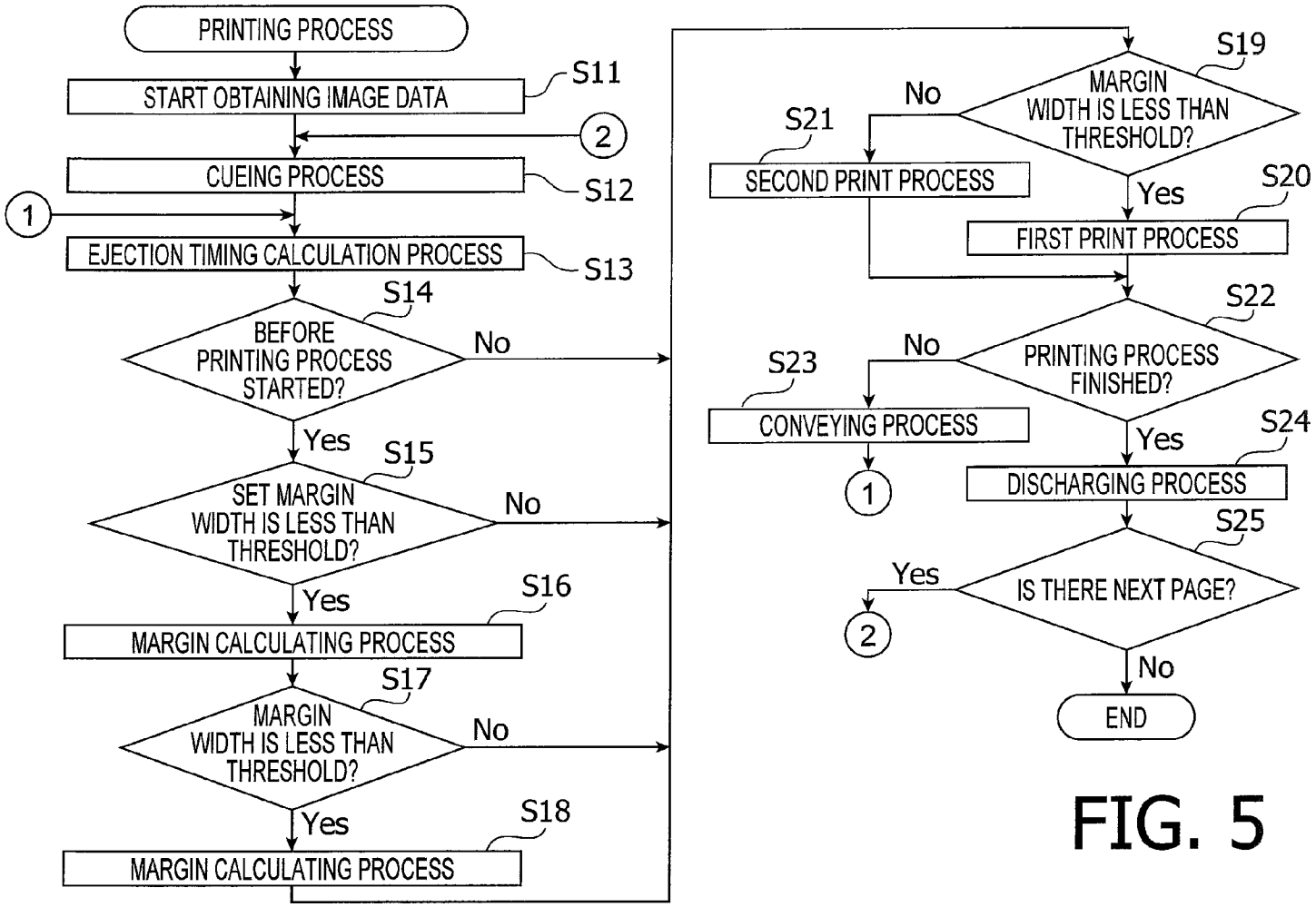

FIG. 5 is a flowchart illustrating a printing process according to aspects of the disclosures.

Figure 6:
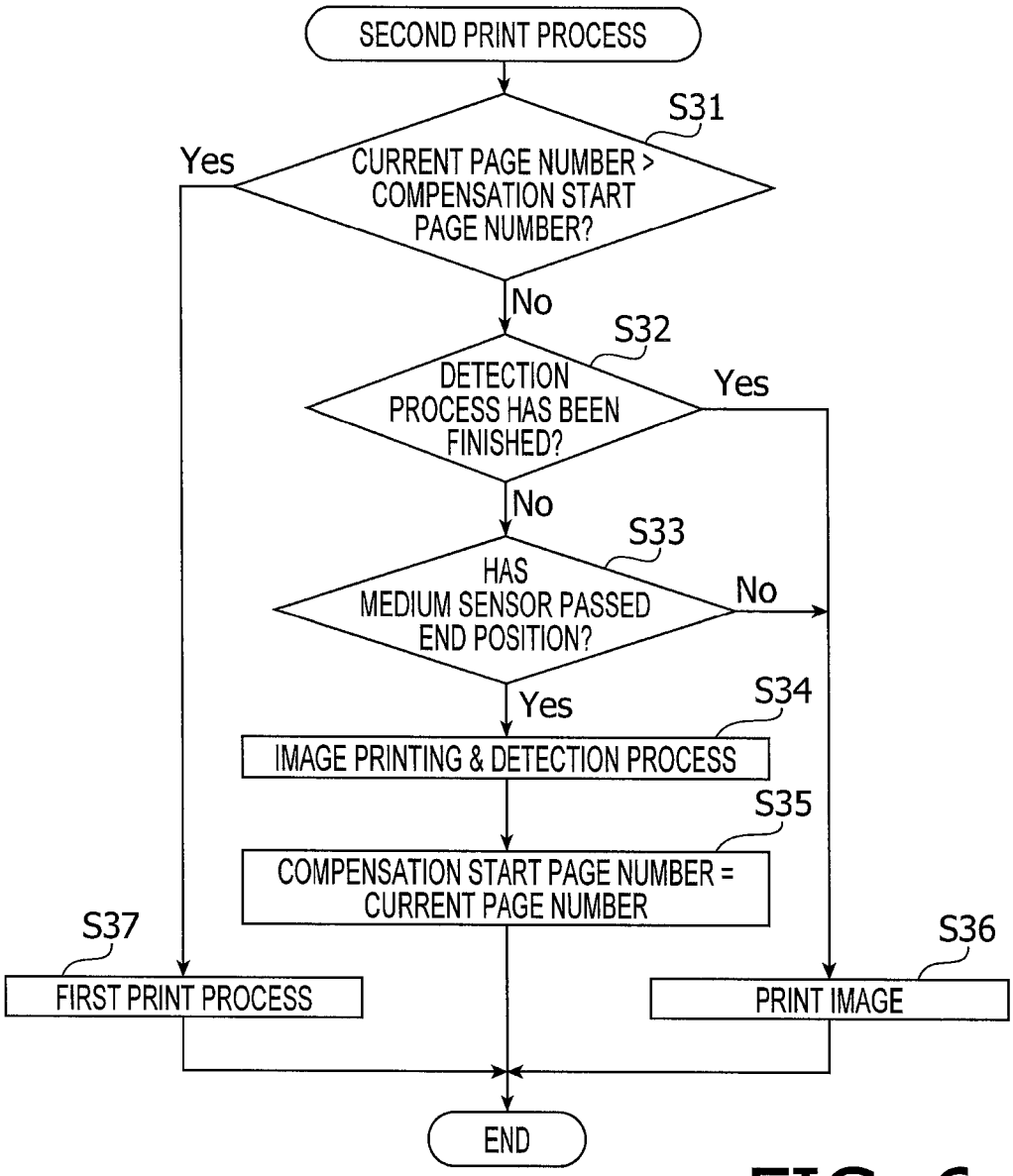

FIG. 6 is a flowchart illustrating a second print process according to aspects of the disclosures.

Figure 7:
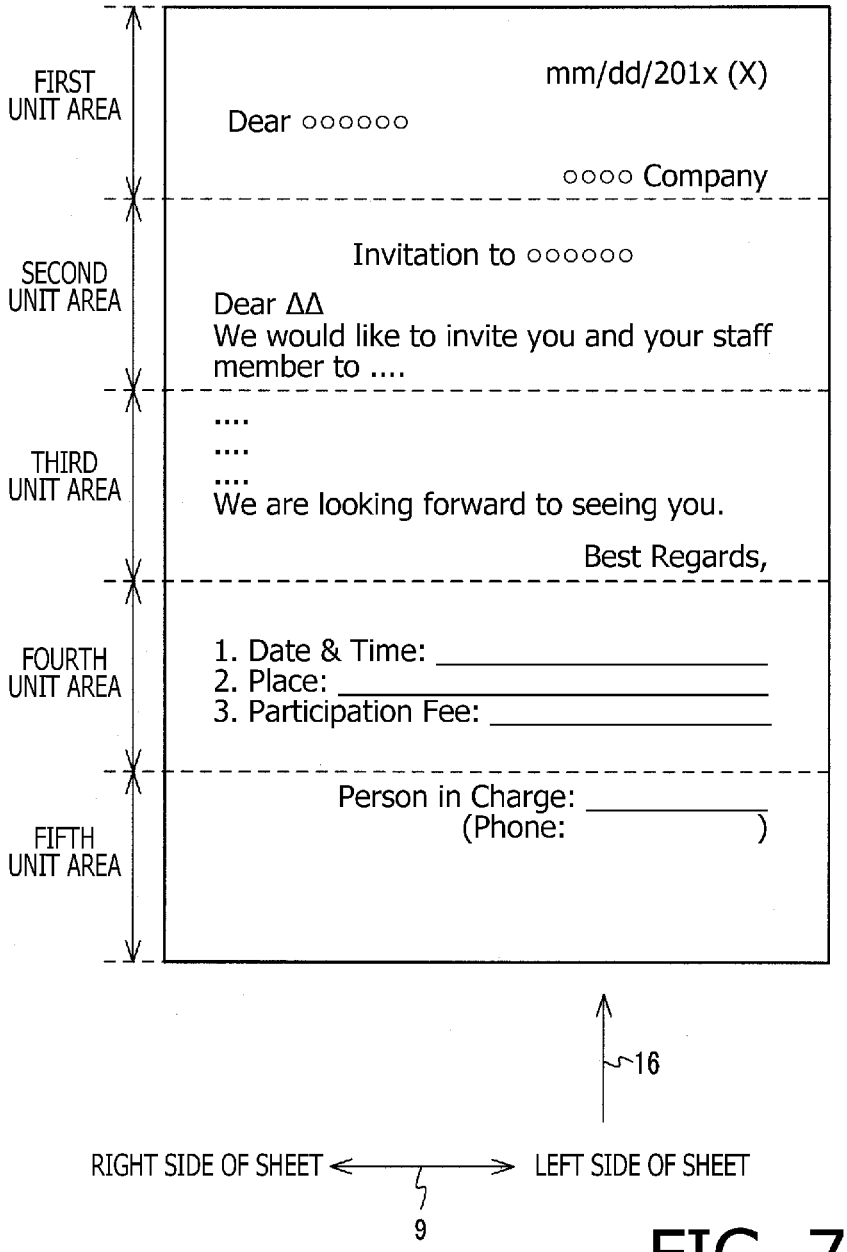

FIG. 7 shows an example of an image which is to be printed on a sheet by the MFP.

Figure 8:
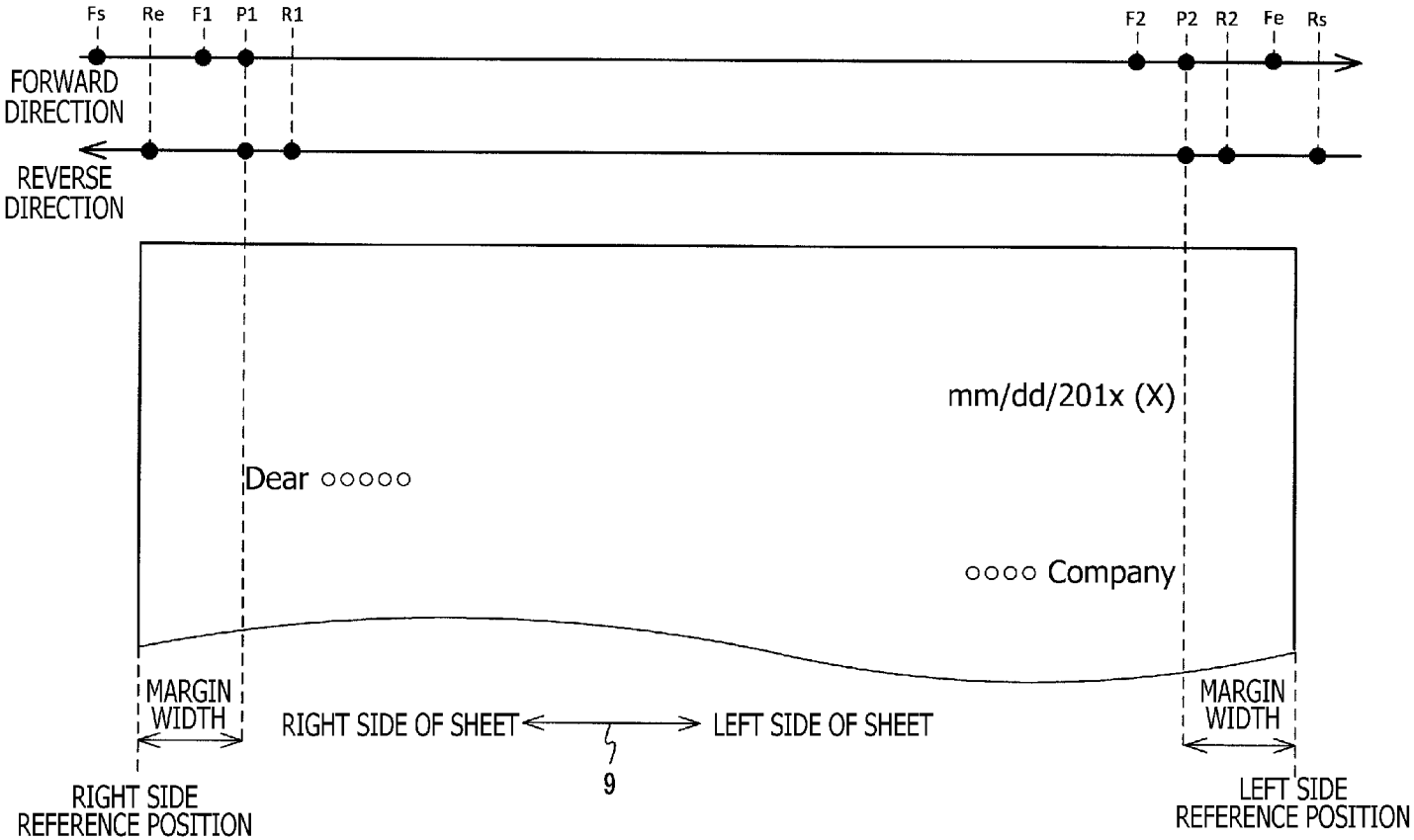

FIG. 8 is a chart illustrating an ejection start position, an ejection termination position, a movement start position and a movement termination position according to aspects of the disclosures.

Figure 9:
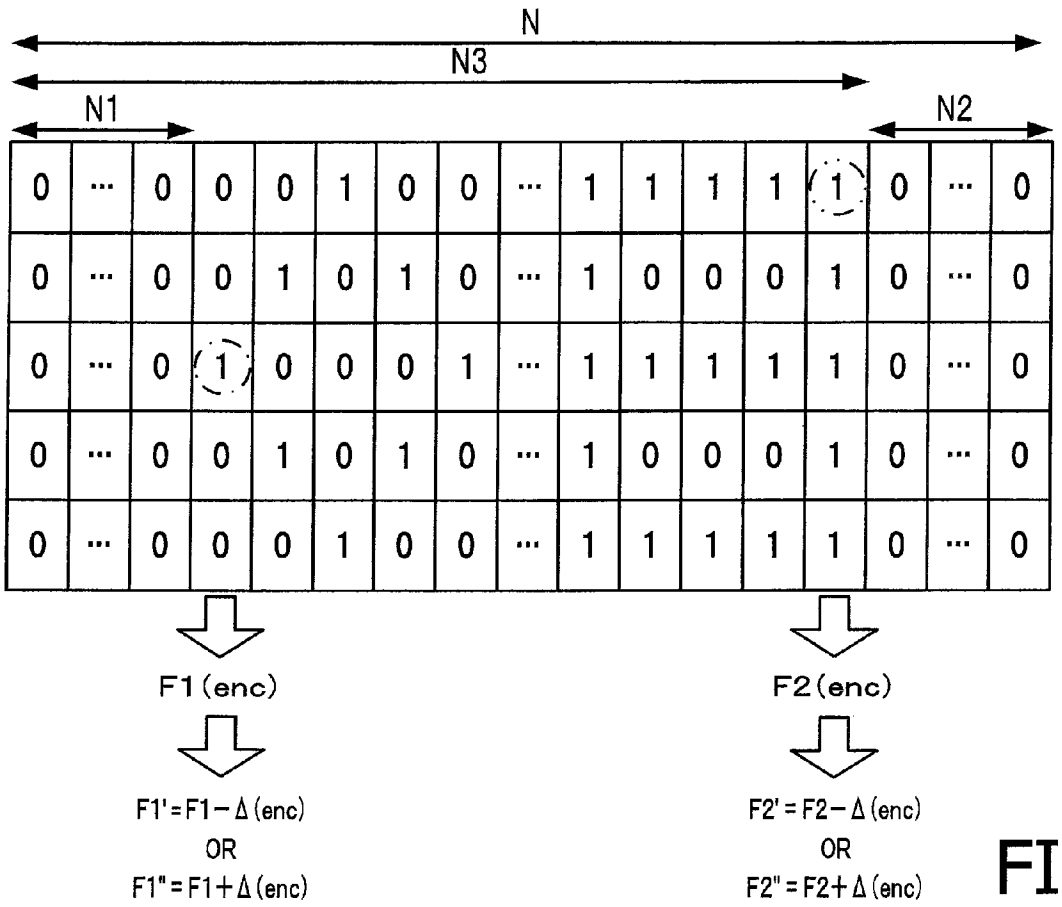

FIG. 9 schematically shows an example of raster data according to aspects of the disclosures.

DETAILED DESCRIPTION OF THE EMBODIMENT

Hereinafter, referring to the accompanying drawings, an illustrative embodiment according to aspects of the disclosures will be provided. It should be noted that the illustrative embodiment described hereinafter is merely an example and various modification may be realized without departing from the aspects of the disclosures.

It is noted that various connections are set forth between elements in the following description. It is noted that these connections in general and, unless specified otherwise, may be direct or indirect and that this specification is not intended to be limiting in this respect. Aspects of the present disclosure may be implemented on circuits (such as application specific integrated circuits) or in computer software as programs storable on computer-readable media including but not limited to RAMs, ROMs, flash memories, EEPROMs, CD-media, DVD-media, temporary storages, hard disk drives, floppy drives, permanent storages, and the like.

Figure 1:
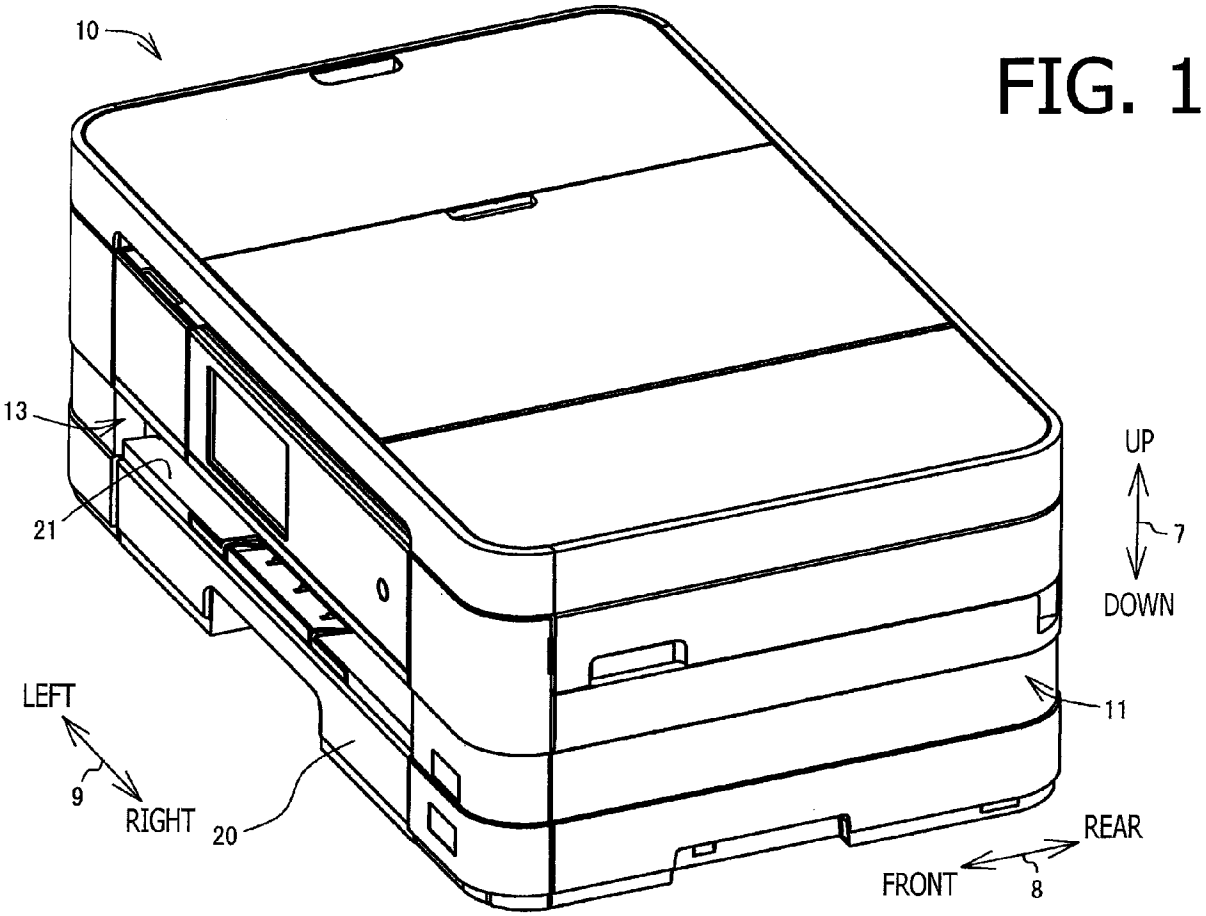
FIG. 1 is a perspective view of an MFP (multi-function peripheral) according to aspects of the disclosures.

In the following description and drawings, directions will be defined such that up and down directions are defined with respect an MFP (multi-function peripheral) 10 placed for use as shown in FIG. 1. Further, a direction on which an opening 13 is formed on a casing of the MFP 10 is defined as a front side of the MFP 10, an opposite side is defined as a rear side, and right and left sides when the MFP 10 is viewed from the front side are defined as right and left sides of the MFP 10, respectively. In the following description, an up-and-down direction 7, a front-and-rear direction 8 and a right-and-left direction 9 are defined based on the above definitions.

The MFP 10 has a substantially cuboids outer shape as shown in FIG. 1. The MFP 10 has a printer unit 11 provided on a lower part thereof. The printer unit 11 is configured to print images on sheets 12 in accordance with an inkjet printing method. The printer unit 11 is, as shown in FIG. 2, provided with a feeding unit 14, a feeding tray 20, a discharging tray 21, a conveying roller unit 54, a printing unit 24, a discharging roller unit 55 and a platen 42.

An opening 13 is formed on the front surface of the printer unit 11, and the feeding tray 20 is configured to be slidably attached to and removed from the printer unit 11 through the opening 13. The feeding tray 20 is configured to support a plurality of sheets 12 which are to be fed to a conveying path 65 by the feeding unit 15. The discharging tray 21 is arranged above the feeding tray 20. The discharging tray 21 supports the sheets 12 discharged by the discharging roller unit 55. According to the illustrative embodiment, the sheet 12 supported by the feeding tray 20 are aligned by a center aligning, which is an aligning of the sheets 12 such that the center, in the right-and-left direction 9, of the sheet 12 is aligned to coincide with the center, in the right-and-left direction 9, of the supporting surface of the feeding tray 20.

Figure 2:
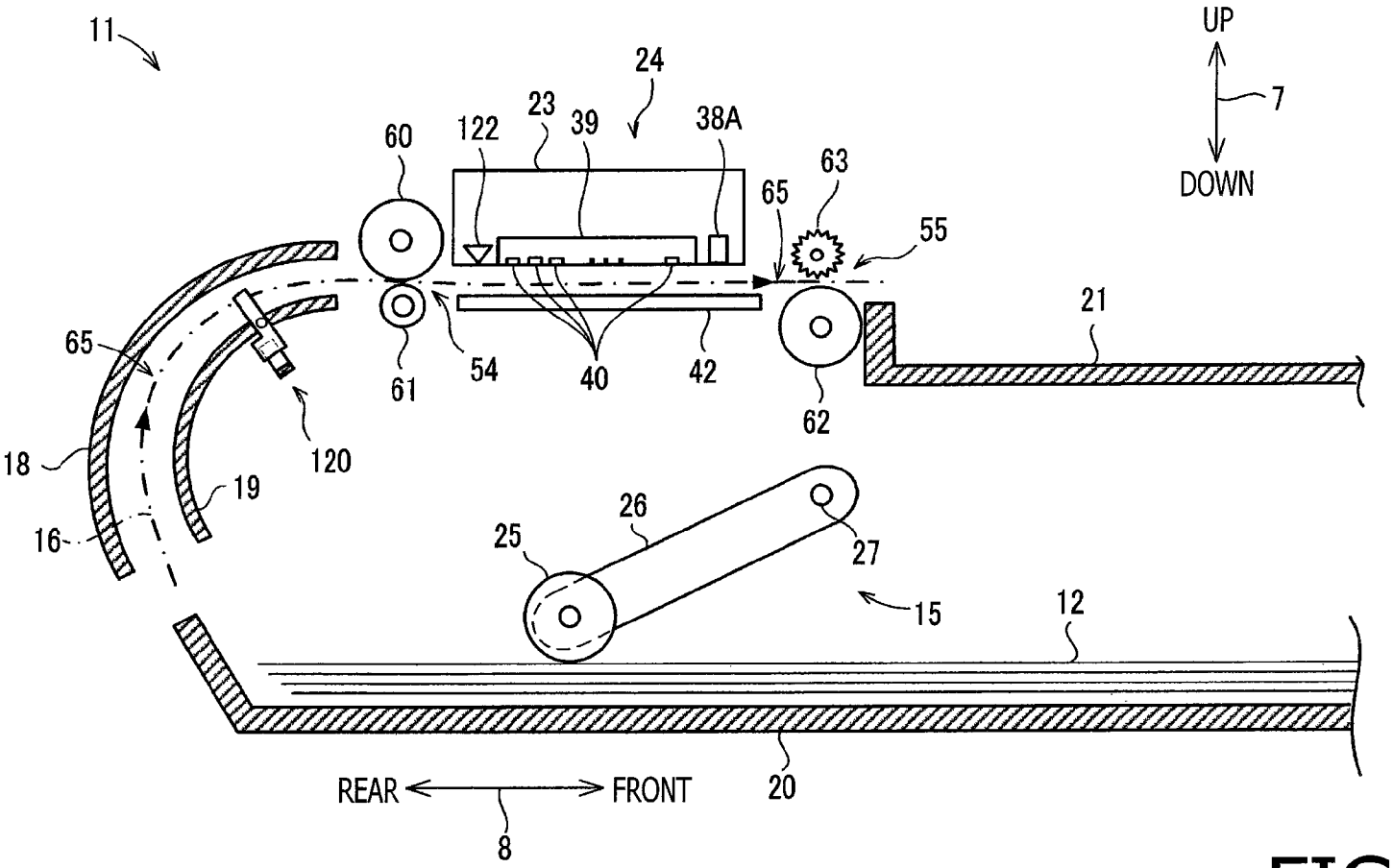
FIG. 2 is a cross-sectional side view showing main components inside a printer unit of the MFP shown in FIG. 1.

The feeding unit 15 is, as shown in FIG. 2, provided with a feeding roller 25, a feeding arm 26 and a shaft 27. The feeding roller 25 is rotatably supported at a tip end of the feeding arm 26. The feeding roller 25 is driven to rotate in a direction where the sheet 12 is fed in the conveying direction 16 as a feeding motor 102 (see FIG. 4) is reversely rotated. The feeding arm 26 is urged toward the feeding tray 20.

The conveying path 65 is a space, a part of which is defined by an outer guide member 18 and an inner guide member 19, which face each other with a predetermined distance therebetween, inside the printer unit 11 as shown in FIG. 2. The conveying path 65 extends from a rear end portion of the feeding tray 20 toward the rear end portion of the printing unit 24. The conveying path 65 is formed to make a U-turn at the rear end portion of the printer unit 11 from a lower side to an upper side, and further extends toward the discharging tray 21 via the printing unit 24. A sheet conveying direction 16 inside the conveying path 65 is indicated by a dotted line in FIG. 2.

The conveying roller unit 54 is arranged on an upstream side, in the conveying direction 16, with respect to the printing unit 24 as shown in FIG. 2. The conveying roller unit 54 is provided with a conveying roller 60 and a pinch roller 61 which face each other. The conveying roller 60 is driven to rotate by a conveying motor 102. The pinch roller 61 is driven by rotation of the conveying roller 60 to rotate. When the conveying motor 102 forwardly rotates, the sheet 12 nipped between the rotating conveying roller 60 and the pinch roller 61 is conveyed in the conveying direction 16.

The discharging roller unit 55 is arranged on a downstream side, in the conveying direction 16, with respect to the printing unit 24 as shown in FIG. 2. The discharging roller unit 55 is provided with a discharging roller 62 and a spur roller 63 which face each other. The discharging roller 62 is driven to rotate by the conveying motor 102. The spur roller 63 is driven by rotation of the discharging roller 62 to rotate. The sheet 12 nipped between the discharging roller 62 and the spur roller 63 is conveyed in the conveying direction 16 as the conveying motor 102 rotates forwardly.

The printer unit 11 is provided with a registration sensor 120 on the upstream side, in the conveying direction 16, with respect to the conveying roller unit 54. The registration sensor 120 is configured to output a low level signal, which is a detection signal, to a control unit 130 (described later) in response to presence of the sheet 12 at a detection position, which is a position where the registration sensor 120 is arranged. The registration sensor 120 is also configured to output a high level signal, which is also a detection signal, in response to absence of the sheet 12 at the detection position, to the control unit 130.

The printer unit 11 is provided with a well-known rotary encoder 121 configured to output a pulse signal synchronously with a rotation of the conveying roller 60, as shown in FIG. 4. The rotary encoder 121 is provided with an encoding disc and an optical sensor. The encoder disc is configured to rotate together with the conveying roller 60, while the optical sensor reads a predetermined pattern formed on the encoder disc and generates a pulse signal, which is transmitted to the controlling unit 130.

The printing unit 24 is arranged between, in the conveying direction 16, the conveying roller unit 54 and the discharging roller unit 55, as shown in FIG. 2. The printing unit 24 is arranged to face a platen 42 in the up-and-down direction 7. The printing unit 24 is provided with a carriage 23, a printing head 39, an encoder senor 38A, and a medium sensor 122.

From the carriage 23, an ink tube 32 and a flexible flat cable 33 extend, as shown in FIG. 3. The ink tube 32 is configured to supply ink contained in the ink cartridge to the printing head 39. The flexible flat cable 33 connects the controller substrate on which the control unit 130 is arranged with the printing head 39.

The carriage 23 is supported by the guide rails 43 and 44 which are arranged at positions spaced from each other in the front-and-rear direction 8 as shown in FIG. 3. The carriage 23 is connected to a well-known belt mechanism provided to the guide rail 44. That is, the belt mechanism is provided with a driving pulley 47 arranged at an end portion, in the right-and-left direction 9, of the guide rail 44, a driven pulley 48 arranged at the other end portion, and a belt 49 wound around the driving pulley 47 and the driven pulley 48.

The carriage 23 is secured to the belt 49. As the carriage motor 103 (see FIG. 4) rotates, the driving pulley 47 rotates and causes the belt 49 to perform a round movement. Then, the carriage 23 reciprocally moves in the right-and-left direction 9 (also referred to as a scanning direction). Specifically, when the motor 103 forwardly rotates, the carriage 23 moves in a forward direction, which is a direction directed from the right end to the left end in the right-and-left direction 9. Further, when the motor 103 reversely rotates, the carriage 23 moves in a reverse direction, which is a direction directed from the left end to the right end, in the right-and-left direction 9, in FIG. 3.

The printing head 39 is mounted on the carriage 23 as shown in FIG. 2. On the lower surface of the printing head 39, a plurality of nozzles 40 are formed. The printing head 39 is configured to eject the ink through the nozzles 40 as minute ink drops. During movement of the carriage 23, the printing head 39 ejects the ink drops onto the sheet 12 supported by the platen 42, thereby an image being printed on the sheet 12.

The printing unit 24 executes a printing process to cause the printing head 39 to ejects the ink drops when the carriage 23 is moving in the forward direction or the reverse direction at least once, typically a plurality of times, to print an image on the sheet 12. In the present specification, an area of the sheet 12 on which an image is printed by one printing process will be defined as a unit area. As shown in FIG. 7, an entire area of the sheet 12 is divided into a plurality of unit areas which are next to each other in the conveying direction 16. In the example shown in FIG. 7, the entire area of the sheet 12 is divided into five unit areas, which will be referred to as first, second, third, fourth and fifth areas as indicated in FIG. 7. The printing unit 24 prints an image in the first to fifth areas in this order.

On the guide rail 44, a belt-like encoder strip 38B is attached. The encoder sensor 38A is mounted on the carriage 23 so as to face the encoder strip 38B. As the carriage 23 moves, the encoder sensor 38A reads the encoder strip 38B to generate a pulse signal, and transmits the pulse signal to the control unit 130. The encoder sensor 38A and the encoder strip 38B constitute the carriage sensor 38.

The platen 42 is arranged between, in the conveying direction 16, the conveying roller unit 54 and the discharging roller unit 55 as shown in FIG. 2. The platen 42 is arranged to face, in the up-and-down direction 7, the printing unit 24, and is configured to support the sheet 12 having been conveyed by the conveying roller unit 54. According to the embodiment, a reflection index of the platen 42 is designed to be smaller than that of the sheet 12.

The medium sensor 122 is mounted on the carriage 23 as shown in FIG. 2. The medium sensor 122 has a light emitting unit and a light receiving unit. The light emitting unit is configured to emit light of which amount is controlled by the control unit 130. The light emitted by the light emitting unit is reflected by the sheet 12 supported by the platen 42, or by the platen 42 itself if the sheet 12 is not supported thereon. The light receiving unit receives the reflected light. The medium sensor 122 is configured to transmit a detection signal representing the light amount of the received light to the control unit 130. For example, the medium sensor 122 transmits the detection signal of a higher level as the light amount of the received signal is higher.

The MFP 10 has a communication unit 14 as shown in FIG. 4. The communication unit 14 is an interface to communicate with an external device through a communication network. That is, the MFP 10 is capable of obtaining information from external devices through the communication unit 14. The communication network needs not be limited to a particular one, and examples may be a wired LAN (local area network), a wireless LAN, or a combination thereof. Further, the communication unit 14 may be an interface having a cable such as a USB (universal serial bus) cable to be directly connected with an external device.

The control unit 130 has, as shown in FIG. 4, a CPU (central processing unit) 131, a ROM (read only memory) 132, a RAM (random access memory) 133, an EEPROM (electrically erasable ROM) 134, and an ASIC (application specific integrated circuit) 135, which are interconnected through an inner bus 137. The ROM 132 stores programs causing the CPU 131 to control operations of respective components in the MFP 10. The RAM 133 is used as a temporary storage in which data and/or signals, which the CPU 131 uses when the CPU 131 executes the programs, are temporarily stored and/or used as a work area for data processing. The EEPROM 134 stores settings/parameters and flags to be retained after the MFP 10 is powered off.

To the ASIC 135, the conveying motor 102 and the carriage motor 103 are connected. The ASIC 135 obtains driving signals to rotate the conveying motor 102 and the carriage motor 103 from the CPU 131, and applies driving currents corresponding to the obtained driving signals to the conveying motor 102 and the carriage motor 103, respectively. Each motor is driven in accordance with the driving current from the ASIC 135 to forwardly or reversely rotate.

For example, the control unit 130 controls the rotation of the conveying motor 102 to drive respective rollers. Further, the control unit 130 drives the movement of the carriage motor 103 to reciprocally moves the carriage 23. Further, the control unit 130 controls the printing head 39 to eject ink drops from the nozzles 40. Furthermore, the control unit 130 obtains printing instruction from the external device through the communication unit 14.

The ASIC 135 is connected with the carriage sensor 38, the registration sensor 120, the rotary encoder 121 and the medium sensor 122. The control unit 130 is configured to detect a position of the carriage 23 based on the pulse signal output by the carriage sensor 38. Further, the control unit 130 is configured to detect the position of the sheet 12 based on the detection signal output by the registration sensor 120 and the pulse signal output by the rotary encoder 121. Further, the control unit 130 is configured to detect side end positions of the sheet 12 in the right-and-left direction 9.

Next, referring to FIGS. 5-8, a printing process executed by the MFP 10 will be described. The printing process is executed by the CPU 131 of the control unit 130. It is noted that the processes described below may be executed as the CPU 131 retrieves programs stored in the ROM 132 and executes the same, or executed by a hardware circuit implemented to the control unit 130.

A printing process shown in FIG. 5 is executed by the control unit 130 in response to the control unit 130 obtaining a printing instruction from the external device through the communication unit 14. Specifically, the control unit 130 executes the printing process in response to obtaining the control data included in the printing instruction. The printing instruction includes image data in addition to the control data. The printing instruction is an instruction to cause the MFP 10 to execute the printing process for printing the image represented by image data on the sheet 12. It is noted that the image data is arranged after the control data in the printing instruction.

In the control data, for example, part of or all of resolution data and set margin data. The resolution data is data indicating a resolution of the image data. The resolution is, for example, a value of which a unit is "dpi," and includes the resolution value in the front-and-rear direction 8 and the resolution value in the right-and-left direction 9. The set margin data is data representing set margin set in the external device. The set margin represents widths of a frame-like area corresponding to a peripheral area of the sheet 12 to which the ink drops will not be ejected. Thus, the image represented by the image data is to be printed inside the above frame-like area. It is noted, however, the size of the image data is determined arbitrarily. Therefore, the actual margin widths may be larger than the set margin widths. The set margin widths of upper, lower, right and left margins may be determined separately, or commonly. Further, a value set to each of the pixels within the above-mentioned frame-like area is zero, or represents "no color." The image data may represent one image to be printed on one piece of sheet 12, or a plurality of sheets 12 to be printed on a plurality of pages of sheets 12, respectively.

Initially, the control unit 130 starts obtaining image data included in the printing instruction (S11). That is, the control unit 130 subsequently obtains image data transmitted from the external device through the communication unit 14, and stores the obtained image data in an image data memory (e.g., the RAM 133 or the EEPROM 134). Further, the control unit 130 initializes a current page number and a compensation starting page number, which are inner variables. Specifically, the control unit 130 sets the current page number to zero (0), and sets the compensation starting page number to its maximum value. The current page number and the compensation starting page number will be described in detail later.

The control unit 130 sequentially generates raster data, which is schematically shown in FIG. 9, by converting the image data stored in the image data memory during the obtaining process (S13). The raster data has a plurality of pixel values (e.g., "0" and "1" shown in FIG. 9). In the present embodiment, the pixel value of "0" represents a pixel for which the printing head 39 does no eject an ink drop (such a pixel will be referred to as a non-ejection pixel), while the pixel value of "1" represents a pixel for which the printing head 39 ejects an ink drop.

Hereinafter, an example that an image is printed in one unit area in accordance with one printing process by ejecting the ink drops from the printing head 39 based on five rows of raster data shown in FIG. 9 will be described.

The control unit 130 executes a cueing process (S12). The cueing process is to convey the sheet 12 supported by the feeding tray 20 to a position where an area of the printing sheet 12 in which an image is initially printed faces the printing head 39 with the feeding roller 25, the conveying roller unit 54 and the discharging roller unit 55. The cueing process is executed in parallel with the obtaining process which is started in S11. It is noted that the control unit 130 increments the number of current page by one every time the cueing process is executed.

Specifically, in S12, the control unit 130 reversely drives the conveying motor 102 so that the conveying roller 25 is rotated until the leading end of the sheet 12 reaches the conveying roller unit 54. Next, the control unit 130 forwardly drives the conveying motor 102 to rotate the conveying roller 25 and the discharging roller 62 until the area of the sheet 12 in which an image is to be initially printed faces the printing head 39.

Next, the control unit 130 executes an ejection timing calculation process (S13). The ejection timing calculation process is for calculating ink ejection timings necessary to print an image, which is represented by the image data obtained in S11, on the sheet 12, assuming that the sheet 12 is located to meet reference positions. According to the embodiment, in the ejection timing calculation process, ejection timings of the ink drops which are to be ejected to a unit area within which an image will be printed next is calculated.

The reference positions are positions at which the right and left sides of the sheet 12 are to be aligned when the sheet 12 faces the printing head 39. Specifically, two reference positions are defined for each size of the sheet 12. FIG. 3 shows a right side reference position indicating the position at which the right side of the sheet 12 is to be aligned, and a left side reference position at which the left side of the sheet 12 is to be aligned are indicated. Although two reference positions are indicated in FIG. 3, only one of the right side reference position and the left side reference position may work. It is noted that the reference positions may be identified by the encoder values, which are the numbers of the pulses known from the pulse signal with reference to one end, in the right-and-left direction 9, of the encoder strip 38B.

Referring to FIGS. 8 and 9, a process of calculating the ejection timings for printing the image in the first unit area (FIG. 7) will be described. In the ejection timing calculation process, the control unit 130 calculates an ejection position, which is a position of the printing head 39 (or, specifically the position of a nozzle 40) when an ink drop is ejected to impact on each impact position on the sheet 12, as a position represented by an ejection timing. It is noted that, each ejection position may be identified by the control unit 130 based on an encoder value output by the carriage sensor 38. That is, the encoder value of the carriage sensor 38 represents the ejection position. Thus, the control unit 130 causes the printing head 39 to eject the ink drops when the carriage 23 reaches the ejection position.

For example, when the carriage 23 is forwardly moved in the printing process, the printing head 39 ejects the ink drop to impact an impact position P1 (FIG. 8) when the nozzle that is to eject the ink drop is located at an ejection position of F1. The impact position P1 corresponds to a left-hand side end of a circle-like characters on a second line of the sheet 12 in FIG. 8. It is noted that, due to the definition of the right and left directions with respect to the MFP 10, the right-hand side of FIG. 8 is the left side of the sheet 12, and the left-hand side of FIG. 8 is the right side of the sheet 12. The ejection position F1 is on the upstream side, in the forward direction, with respect to the impact position P1.

In FIG. 9, the pixel for causing the ink drop to impact the impact position P1 is a pixel of which value is "1" and which is circled with a one-dotted line in FIG. 9. The control unit 130 transmits the drive signal to the printing head 39, when the carriage 23 (or, the nozzle) moving in the forward direction has reached the ejection position F1, to cause the printing unit 39 to eject an ink drop corresponding to the ejection position F1. The pixel corresponding to the ejection position F1 is the pixel of which value is "1" and which is circled with a one-dotted line in FIG. 9. A distance between the impact position P1 and the ejection position F1 in the right-and-left direction 9 can be identified based on a moving speed of the carriage 39 and a flying time of the ink drop (i.e., a time period before an ink drop ejected from the printing head 39 reaches the sheet 12).

Similarly, the printing head 39 ejects an ink drop to impact an impact position P2 at an ejection position of F2. The ink drop to reach the impact position P2 reaches a right-hand side end of a closing parenthesis on the first line on the sheet 12 in FIG. 8. The ejection position F2 is on the upstream side, in the forward direction, with respect to the impact position P2.

In FIG. 9, the pixel for causing the ink drop to impact the impact position P2 is a pixel of which value is "1" and which is circled with a two-dotted line. When the carriage 23 moving in the forward direction reaches the ejection position F2, the control unit 130 transmits the drive signal to the printing head 39 to eject the ink drop to reach the impact position P2. It is noted that the pixel corresponding to the ejection position F2 is the pixel of which value is "1" and which is circled with a two-dotted line in FIG. 9. Although not described, relationship between other impact positions and corresponding ejection positions is the same.

Among a plurality of ejection positions identified in the above-described method, the ejection position located at the most upstream side, in the forward direction, is defined as an ejection start position, and the ejection position located at the most downstream side, in the forward direction, is defined as an ejection termination position. Specifically, the control unit 130 analyses the five rows of line data as shown in FIG. 9 from the left-hand side thereof, and the ejection position F1 which corresponds to the pixel of which value is "1" and which is firstly detected (i.e., the pixel circled with the one-dotted line in FIG. 9) is defined as the ejection start position. Further, the control unit 130 determines the ejection position F1 which corresponds to the pixel of which value is "1" and which is lastly detected (i.e., the pixel circled with the two-dotted line in FIG. 9) is defined as the ejection termination position. Thus, during one printing process, the ejection start position is the position at which the ink drops are ejected firstly, while the ejection termination position is a position at which the ink drops are ejected lastly.

During the ejection timing calculation process, a movement start position Fs of the carriage 23 during the printing process, and a movement end position Fe are determined. The movement start position Fs is a position from which the carriage 23 starts moving in the printing process which is executed in accordance with the ejection timings calculated in the ejection timing calculating process. The movement end position Fe is a position at which the carriage 23 finishes moving (i.e., movement is stopped) during the printing process executed in accordance with the ejection timings calculated in the ejection timing calculating process.

The movement start position Fs is, as shown in FIG. 8, a position spaced from the ejection start position F1 by a predetermined distance on the upstream side in the forward direction. The movement end position Fe is, as shown in FIG. 8, a position spaced from the ejection termination position F2 by a predetermined distance on the downstream side in the forward direction. For example, the movement start position Fs and the ejection start position F1 is spaced by a distance which is necessary to accelerate the moving speed of the carriage 23 so as to reach a predetermined moving speed at the ejection start position F1. That is, the carriage 23 is accelerated between the movement start position Fs and the ejection start position F1, proceeds at a constant moving speed between the ejection start position F1 and the ejection termination position F2, and stops at the movement end position Fe. It is noted that, the movement start position Fs and the movement end position Fe are identified by the encoder values of the carriage sensor 38 by the control unit 130.

If the printing process is executed with moving the carriage 23 in the reverse direction, the printing head 39 ejects the ink drop, at an ejection position R2, so that the ink drop reaches the impact position P2 which is on the upstream side, in the reverse direction, with respect to the impact position P2 Similarly, the printing head 39 ejects the ink drop, at an ejection position R1, so that the ink drop reaches the impact position P2 which is on the upstream side, in the reverse direction, with respect to the impact position P1.

Among a plurality of ejection positions, the most upstream side position, in the reverse direction, is defined as the ejection start position R1, and the most downstream side position, in the reverse direction, is determined as the ejection termination position R1. Further, a movement start position Rs is defined as a position on the upstream side, in the reverse direction, with respect to the ejection start position R2, and a movement end position Re is defined as a position on the downstream side, in the reverse direction, with respect to the ejection termination position R1. Description on details which are similar or analogous to those when the carriage 23 is moved in the forward direction will be omitted for brevity.

When the printing process for the first unit area has not been executed (S14: YES) and the set margin width represented by the set margin data which is included in the printing instruction is less than a threshold value X (S15: YES), the control unit 130 executes a margin calculating process (S16). The margin calculating process is to calculate estimate margin values of the margins formed at both ends, in the right-and-left direction 9, of the sheet 12. The margin calculating process is executed after the cueing process is completed. It is noted that, in the margin calculating process, the estimated margin values are calculated based on the image data representing the image to be printed in the first unit area. The image to be printed in the first unit area is the image to be printed in the firstly-executed printing process, or the image printed in the area which faces the printing head 39 in the cueing process. According to the illustrative embodiment, the image data representing the image to be printed in the first unit area is five rows of raster data as shown in FIG. 9.

The estimate margin values are values identifying the reference positions of the sheet 12 and the impact positions closest to the respective reference positions in the right-and-left direction 9. In the example shown in FIG. 8, the estimate margin values are values identifying a distance between the right side reference position and the impact position P1, and the left side reference position and the impact position P2, respectively. As mentioned above, the reference positions are fixed values determined to each size of the sheet 12. Further, the impact positions P1 and P2 can be identified by the ejection start position and the ejection termination position. That is, in the margin calculation process according to the present embodiment, the ejection start position and the ejection termination position are calculated as the estimate margin values.

Next, when the margin widths estimated based on the estimate margin values calculated in S16 is less than the threshold width X (S17: YES), the control unit 130 executes a detection process (S18). Specifically, the control unit 130 calculates a distance between the ejection start position F1 and the right side reference position. If the thus calculates distance is less than the threshold width X, the control unit 130 executes the detection process (S18). It is noted that comparison with the margin width and the threshold width at the left side of the sheet 12 is similar to the above and the description thereof is omitted for brevity. It is noted that the right side reference position is represented by a fixed value. Therefore, the control unit 130 may determine whether the detection process is to be executed (S18) by comparing the encoder value representing the ejection start position F1 and another encoder value representing a position spaced inward from the right side reference position by the threshold width X in S17.

The detection process (S18) is a process to detect the end positions, in the right-and-left direction 9, of the sheet 12 which has been conveyed to the position to face the printing head 39 by the cueing process. Specifically, the control unit 130 moves the carriage 23 in the right-and-left direction 9 with light being emitted from right and left light emitting units. Then, the control unit 130 detects positions at which a changed of the amount of the detection signal output by the medium sensor 122 is equal to or greater than a predetermined threshold value. The positions at which the changed amount of the detection signal is equal to or greater than the predetermined threshold value are determined to be end positions of the sheet 12. The end positions are identified by the encoder values of the carriage sensor 39 by the control unit 130.

When each of the margin widths estimated based on the estimate margin values is equal to or greater than the threshold width X (S17: NO), the control unit 130 executes S19 without executing S18. When the set margin width is equal to or greater than the threshold margin width X (S15: NO), the control unit 130 executes S19 without executing S16-S18. Further, when the printing process with respect to the first unit area has already been executed (S14: NO), the control unit executes S19 without executing S15-S18.

Next, the control unit 130 executes printing process (S20 and S21). The printing process is a process to move the carriage 23 in the right-and-left direction 9, and causes the printing head 39 to eject the ink drops.

It is noted that, when the margin width estimated based on the estimate margin value is less than the threshold width X (S19: YES), the control unit 130 executes a first print process (S20). When the margin width estimated based on the estimate margin width value is equal to or greater than the threshold width X (S19: NO), the control unit 130 executes a second print process (S21).

In the first print process (S20), the control unit 130 compensates the ejection timings (therefore, the ejection positions) calculated in S13 based on a difference A between the end position detected in S18 and the reference position. Then, the control unit 130 causes the printing head 39 to eject the ink drops based on the ejection timings (which will be referred to as compensated ejection timings) during the carriage 23 is being moved in the right-and-left direction 9.

For example, in the printing process in which the carriage 23 is moved in the forward direction, if the end position is displaced on the upstream side, in the forward direction, with respect to the reference position, the control unit 130 shifts each ejection position on the upstream side, in the forward direction, by the amount corresponding to the difference A between the end position and the reference position. That is, the control unit 130 causes the printing head 39 to eject ink drops at the compensated ejection timings which are earlier than the ejection timings calculated in S13. Specifically, as shown in FIG. 9, the control unit 130 determines a position F1−Δ(enc), which represents a position displaced form the ejection start position F1 by the distance Δ, as the compensated ejection start position F1' which corresponds to the compensated ejection timing. It is noted that "enc" is an encoder value of the carriage sensor 38 in the main scanning direction.

If the end position is displaced on the downstream side, in the forward direction, with respect to the reference position, the control unit 130 shifts each ejection position on the downstream side, in the forward direction, by the amount corresponding to the difference A between the end position and the reference position. That is, the control unit 130 causes the printing head 39 to eject ink drops at the compensated ejection timings which are later than the ejection timings calculated in S13. Specifically, as shown in FIG. 9, the control unit 130 determines a position F1+Δ(enc), which represents a position displaced form the ejection start position F1 by the distance Δ, as the compensated ejection start position F1" which corresponds to the compensated ejection timing.

It is noted that, in the printing process in which the carriage 23 is moved in the reverse direction, the control unit 130 compensates the ejection timings in the similar manner.

When the current page number is equal to or greater than the compensation start page number (S31: NO), the detection process has not been executed (S32: NO) and the medium sensor 122 is passing a position facing the end of the sheet 12 (S33: YES) in the second print process (21), the control unit 130 prints the image on the sheet 12 in accordance with the ejection timings calculated in S13, and executes the detection process (S34). Further, the control unit 130 the page number of the current page to the compensation start page (S35) and terminates the second print process.

Specifically, the control unit 130 moves the carriage 23 in the right-and-left direction 9 with the light being emitted from the light emitting unit of the medium sensor 122 (S34). Further, the control unit 130 causes the printing head 39 to eject ink drops at the ejection timings calculated in S13 when the carriage 23 is moved in the right-and-left direction 9. Further, the control unit 130 detects the position at which change of the detection signal output by the medium sensor 122 is equal to or greater than the threshold change value as the end position of the sheet 12.

When the detection process has already been executed (S32: YES), the control unit 130 prints the image (S36) on the sheet 12 in accordance with the ejection timings calculated in S13, and terminates the second print process. Similarly, when the medium sensor 122 does not pass the position facing the end positions of the sheet 12 (S33: NO), the control unit prints the image on the sheet 12 (S36) in accordance with the ejection timings calculated in S13, and terminates the second print process. The process in S36 is similar to the process of printing the image on the sheet 12 in S34, and the description thereof will not be repeated for brevity. Further, when the current page number exceeds the page number of the compensation start page (S31: YES), the control unit 130 executes the first print process (S37) and terminates the second print process.

In FIG. 5, when the printing of the image on the sheet 12 has not been completed (S22: NO), the control unit 130 executes the conveying process (S23). Specifically, the control unit 130 forwardly drives the conveying motor 102 to cause the conveying roller 54 and the discharging roller 55 to convey the sheet 12 in the conveying direction 16 by a predetermined line feed width.

The control unit 130 repeatedly executes S13-S23 until the printing of images on the sheet 12 is completed (S22: YES). When printing of the images on the sheet 12 is completed (S22: YES), the control unit 130 executes a discharging process to discharge the sheet 12 on which the image has been printed onto the discharging tray 21 (S24). Specifically, the control unit 130 forwardly drives the conveying motor 102 unit the sheet 12 is discharged on the discharging tray 21. The control unit 130 repeatedly executes S12-S24 until all the images included in the printing instruction have been printed (S25: YES), that is, until an image has been printed on the fifth unit area, according to the present embodiment. It is noted that the image data used in the repeatedly executed ejection timing setting process (S13) is changed to a second unit area, a third unit area, a fourth unit area and a fifth unit area as the printing process proceeds. When all the images included in the printing instruction have been printed (S25: NO), the control unit 130 terminates the image printing process.

According to the above-described illustrative embodiment, when the margin width is equal to or greater than the threshold value (S17: NO), the detection process (S18) is skipped, and the images are printed (S34 and S36) on the sheet 12 in accordance with the second print process, without compensating the ejection timings. With this operation, lowering of the throughput in the printing process due to execution of the detection process can be suppressed. When the margin width is relatively large, even if the image is displaced in the main scanning direction, the user may not have uncomfortable feeling about the property of the image. Thus, in such a case, even if the ejection timings are not compensated, subjective quality of the printing will not be largely lowered.

In the margin calculation process according to the above-described illustrative embodiment, the estimate margin width is calculated based on the image data representing the image to be printed in the first unit area. With this configuration, it becomes unnecessary to halt execution of the margin calculation process until all the pieces of the image data are obtained. As a result, for example, in a case where the image data is obtained using a communication line of which communication speed is relatively slow, lowering of throughput of printing process can be suppressed. Further, by executing the margin calculation process after completion of the cueing process, more image data can be used to calculate the estimate margin width without lowering the throughput in the printing process. It is noted, however, if the image data representing the image to be printed in the first unit area can be obtained before the cueing process is completed, execution of the margin calculation process needs not be paused until the cueing process is completed. For example, in such a case, the margin calculation process may be executed during execution of the cueing process.

The margin calculation process according to the above-described illustrative embodiment is executed when the set margin width is less than the threshold width X. It is because the detection process is not necessary and the margin calculation process needs not be executed when the set margin width is equal to or greater than the threshold margin width. Further, the margin calculation process according to the above-described illustrative embodiment is executed only before the first one of the repeatedly executed printing processes (S14: YES). It is noted that aspects of the disclosure need not be limited to such a configuration. That is, the margin calculation process may be executed before the firstly executed printing process or may be executed during a plurality of printing processes.

The margin calculation process may be executed when the number of sheets 12 on which image are to be printed is less than a predetermined threshold value. When the number of sheets 12 is equal to or greater than the threshold value, the detection process may be executed always, while the margin calculation process may not be executed. It is because, when the number of sheets 12 is relatively large, effect of the detection process on the throughput of the image printing process may be relatively lowered. In such a case, however, it is necessary that data indicating the number of the sheets 12 on which the images represented by the image data area printed is included in the control data of the printing instruction.

The image data used in the margin calculation process needs not be limited to have the configuration described above. For example, the image data which has already been obtained when the margin calculation process is started (i.e., when the cueing process or the ejection timing calculation process has finished). For example, in the example shown in FIG. 7, if the image data representing the images to be printed in the first unit area and the second unit area, a distance from the right side reference position to a right side end (i.e., left-hand side end) of a triangular character A is regarded as the right side margin. Further, in the margin calculation process, the image data representing the first page of the sheet 12 (i.e., the image to be printed on the first page of the sheet 12) may be used. Alternatively, all the image data included in the printing instruction may be used. Accuracy of calculation result (i.e., the estimated margin value) is higher as the amount of data used for the calculation is larger. However, it becomes necessary to halt the margin calculation process until necessary image data is obtained.

In the above-described illustrative embodiment, the estimate margin width values for both sides, in the right-and-left direction 9, are calculated respectively. That is, in S17, when each of the margin widths respectively estimated from the two estimate margin width values is less than the threshold width X (S17: YES), the detection process may be executed. S19 is executed in a similar manner. With this configuration, even if the margin widths on both sides, in the right-and-left direction 9, are different, necessity of the detection process can be determined appropriately. It is noted, however, aspects of the disclosures should not be limited to the above-described configuration. That is, only one of the estimate margin width values for the both sides, in the right-and-left direction 9, may be calculated I in the margin calculation process. Further, the detection process may be executed for both sides, in the right-and-left direction 9, of the sheet 12, or only side, in the right-and-left direction 9, of the sheet 12.

The estimate margin width values calculated in the margin calculation process according to the illustrative embodiment need not be limited to refer to the ejection start position and the ejection termination position. For example, the movement start position and the movement termination position may be used as the estimate margin width values. Alternatively, the number of non-ejection pixels continuously arranged at end portion, in the right-and-left direction 9, of the image data and resolution data may be used as the margin width estimation values. It is noted that the non-ejection pixel is defined as a pixel at which the ink drop is not ejected in the printing process (e.g., a pixel representing no color).

Referring to FIG. 9, another example of the margin width estimation values will be described. In FIG. 9, the pixels at the left-hand side end (which correspond to the right side end of the sheet 12) represent the pixels located at the right side reference position (see FIG. 8). In the example shown in FIG. 9, a pixel value of each of the pixels at the left-hand side end is zero (0). Therefore, no ink drops are ejected to the right side reference position. A distance between the right side reference position and the impact position P1 can be identified based on the number N1 of the pixels counted from the left-hand side end one to a pixel immediately before (i.e., on the left-hand side of) the pixel circled by the one-dotted line. Similarly, the pixels at the right-hand side end (which correspond to the left side end of the sheet 12) represent the pixels located at the left side reference position (see FIG. 8).

In the example shown in FIG. 9, a pixel value of each of the pixels at the right-hand side end is zero (0). Therefore, no ink drops are ejected to the left side reference position. A distance between the left side reference position and the impact position P2 can be identified based on the number N2 of the pixels counted from the right-hand side end one to a pixel immediately before (i.e., on the right-hand side of) the pixel circled by the two-dotted line.

When the number of all the pixels in one row is represented by N, and the number of the pixels from the right-hand side end to the pixel on the right-hand side of the one circled by the two-dotted line is represented by N3, the number N2 can be calculated by subtracting N3 from N. Therefore, the control unit 130 may identify the numbers N1 and N2 as the margin width estimation values in the margin calculation process. That is, in this case, the numbers N1 and N2 are used as the margin width estimation values.

The control unit 130 calculates the margin widths by dividing the numbers N1 and N2, which are the margin width estimation values, with the resolution D in the right-and-left direction 9. Then, when N1/D is less that the threshold width X, the control unit 130 may execute the detection process (S18), while when N1/D is equal to or greater than the threshold width X, the control unit 130 may not execute the detection process.

In another example, the ROM 132 stores a plurality of threshold widths X1, X2, X3, . . . Xn respectively associated with a plurality of resolutions D1, D2, D3, . . . Dn, where the Xn represents the number of the pixels. The control unit 130 may obtain the threshold width Xn corresponding to the resolution Dn included in the printing instruction, and may execute the detection process (S18) when N1/D is less than Xn.

In the second print process according to the illustrative embodiment, when the medium sensor 122 passes the end positions of the sheet 12 when the image is being printed on the sheet 12 (S33: YES), the detection process is executed. That is, the detection process in S34 is executed, while the second print process is repeatedly executed, when the medium sensor 122 passes the position facing the end, in the right-and-left direction 9, of the sheet 12. Because of this configuration, it is not necessary to move the carriage 23 only for the detection process, thereby lowering of the throughput in the printing process can be suppressed.

Specifically, in the printing process in which the carriage 23 is moved in the forward direction, when the movement start position Fs is on the upstream side, in the forward direction, with respect to the right side reference position, or when the movement termination position Fe is on the downstream side, in the forward direction, with respect to the left side reference position, the control unit 130 may cause the medium sensor 122 to emit light. When the carriage 23 is moved in the RVS direction, the control unit 130 operates similarly or analogously.

It is noted that the result of the detection at S34 is not reflected in printing of images on the sheet 12 which is subject to detection, and is reflected in printing of an image on the next and subsequent sheets 12 (S37). That is, when images are printed on a first sheet and a second sheet in accordance with the printing instruction, the result of the detection process, which is executed when the images are printed on the first sheet, is reflected in the printing of an image on the second sheet which comes after the first sheet. With this configuration, distortion of the image due to change of the ejection timings during the printing of images on the first sheet can be avoided, and further, images can be printed on the second sheet at appropriate positions. Therefore, lowering of subjective image quality can be suppressed, and the lowering of the throughput in the printing of the images can also be suppressed.

It is noted that the detection process in S34 is executed up to once during the printing of images based on the image data included in the printing instruction. In other words, the control unit does not execute S34 more than one time during the printing process based on one printing instruction. The typical reason of displacement of the sheets 12 in the right-and-left direction 9 is the sheets 12 are supported by the feeding tray 20 with being displaced, with respect to the reference positions, in the right-and-left direction 9. Therefore, the displaced amount of the sheets 12 which are continuously fed from the feeding tray 20 is considered to be substantially the same. Accordingly, for a series of printing processes for a plurality of sheets 12, the detection process is executed up to once, subjective deterioration of printing quality and lowering of the throughput in printing process can be suppressed.

According to the above-described illustrative embodiment, the image data is obtained from the external device through the communication unit 14. Aspects of the disclosures need not be limited to such a configuration. For example, the image data may be one generated by a scanner provided to the MFP 10. For another example, the image data may be obtained from a recording medium attached to a medium attachment unit provided to the MFP 10. The recording medium needs not be limited to a specific one, and one example thereof is a portable recording medium such as a USB memory.

What is claimed is:

1. An inkjet printer, comprising:

a conveyor configured to convey a sheet in a conveying direction;

a carriage configured to be movable in a scanning direction which intersects with the conveying direction, the carriage mounting a printing head configured to eject ink drops on the sheet conveyed by the conveyor and a sensor configured to output a detection signal based on absence/presence of the sheet at a position facing the sensor; and a controller, the controller being configured to execute:

an obtaining process in which the controller obtains image data representing an image to be printed on the sheet;

an ejection timing calculation process in which the controller calculates ejection timings to cause the printing head to eject the ink drops to print the image represented by the image data on the sheet located at a reference position which is a predetermined position in the scanning direction;

a margin calculation process in which the controller calculates, based on the image data, an estimate margin value which is used to determine a margin width at an end, in the scanning direction, of the sheet;

a detection process in which the controller detects end positions, in the scanning direction, of the sheet based on the detection signal during movement of the carriage in the scanning direction in response to the margin width estimated based on the estimate margin value being less than a threshold width; and a printing process in which the controller causes the printing head to ejects the ink drops with moving the carriage in the scanning direction, wherein, in the printing process:

the controller causes the printing head to eject the ink drops in accordance with the ejection timings, which the controller calculates in the ejection timing calculation process, in response to the margin width being equal to or greater than the threshold width; and the controller causes the printing head to eject the ink drops in accordance with compensated ejection timings, which are compensated by the controller based on the end positions detected by the controller in the detection process, in response to the margin width being less than the threshold width.

2. The inkjet printer according to claim 1, wherein the controller is configured to:

in the ejection timing calculation process, calculate a plurality of ejection positions which are positions of the carriage when the controller causes the printing head to eject the ink drops as the ejection timings; and in the margin calculation process, calculate an ejection start position which is a position of the carriage among the plurality of ejection positions and the printing head firstly ejects the ink drops as the estimate margin value.

3. The inkjet printer according to claim 2, wherein the controller is configured to:

in the margin calculation process, calculate an ejection termination position which is a position of the carriage among the plurality of ejection positions and the printing head lastly ejects the ink drops as the estimate margin value.

4. The inkjet printer according to claim 1, wherein the controller is configured to:

in the obtaining process, further obtain resolution data representing a resolution of the image represented by the image data; and in the margin calculation process, calculate a number of non-ejection pixels subsequently arranged in the scanning direction at a portion of the image data corresponding to an end portion of the image represented by the image data and the resolution data as the estimate margin value.

5. The inkjet printer according to claim 1, wherein the controller is configured to execute:

the printing process repeatedly; and the margin calculation process before a first execution of the repeated executions of the printing process.

6. The inkjet printer according to claim 1, wherein the controller is configured to:

execute a cueing process in which the controller causes the conveyor to convey the sheet until an area of the sheet in which an image is to be firstly printed faces the printing head in parallel with the obtaining process; and execute the margin calculation process after the cueing process is completed, wherein, in the margin calculation process, the controller calculates the estimate margin value based on the image data having been obtained at a time when the margin calculation process is started.

7. The inkjet printer according to claim 6, wherein the controller is configured to calculate the estimate margin value based on the image data representing the image to be printed on the area of the sheet located in the cueing process to face the printing head in the margin calculating process.

8. The inkjet printer according to claim 1, wherein the controller is configured to:

calculate the estimate margin values for both end portions of the sheet in the scanning direction in the margin calculation process; and execute the detection process on condition that the margin width estimated based on each of the estimate margin values is less than the threshold width.

9. The inkjet printer according to claim 1, wherein the controller is configured to:

obtain the image data representing a first image and a second image to be respectively printed on a first sheet and a second sheet in the obtaining process;

print the first image on the first sheet by repeatedly executing the ejection timing calculation process, the printing process and the conveying process, the controller causing the conveyor to convey the sheet until an area subjected to be next printing process reaches a position to face the printing head;

when the margin width is equal to or greater than the threshold width, execute the detection process during part of the printing operations, among the repeatedly executed printing operations, where the carriage passes a position at which the carriage faces the end portions of the first sheet; and cause the printing head to eject the ink drops at compensated ejection timings, which are the ejection timings compensated based on the end positions detected in the detection process executed, in the printing process with respect to the second sheet.

10. The inkjet printer according to claim 9, wherein the controller is configured to execute the detection process by maximum of one time while the image represented by the image data is printed.

11. A non-transitory computer readable recording medium storing instructions to be executed by a computer communicatably connected to an inkjet printer which is provided with a conveyor configured to convey a sheet in a conveying direction, and a carriage configured to be movable in a scanning direction which intersects with the conveying direction, the carriage mounting a printing head configured to eject ink drops on the sheet conveyed by the conveyor and a sensor configured to output a detection signal based on absence/presence of the sheet at a position facing the sensor, the instructions cause the computer to execute:

an obtaining process in which the computer obtains image data representing an image to be printed on the sheet;

an ejection timing calculation process in which the computer calculates ejection timings to cause the printing head to eject the ink drops to print the image represented by the image data on the sheet located at a reference position which is a predetermined position in the scanning direction;

a margin calculation process in which the computer calculates, based on the image data, an estimate margin value which is used to determine a margin width at an end, in the scanning direction, of the sheet;

a detection process in which the computer detects end positions, in the scanning direction, of the sheet based on the detection signal during movement of the carriage in the scanning direction in response to the margin width estimated based on the estimate margin value being less than a threshold width; and a printing process in which the computer causes the printing head to ejects the ink drops with moving the carriage in the scanning direction, wherein, in the printing process:

the computer causes the printing head to eject the ink drops in accordance with the ejection timings, which the computer calculates in the ejection timing calculation process, in response to the margin width being equal to or greater than the threshold width; and the computer causes the printing head to eject the ink drops in accordance with compensated ejection timings, which are compensated by the computer based on the end positions detected by the computer in the detection process, in response to the margin width being less than the threshold width.

* * * * *